United States Patent [19]

Mayfield

[11] 3,971,552

[45] July 27, 1976

[54] QUICK RELEASE PIPE VISE

[76] Inventor: Johnny W. Mayfield, 4505 Greenstone Road, Placerville, Calif. 95667

[22] Filed: Nov. 12, 1975

[21] Appl. No.: 631,308

[52] U.S. Cl. ..... 269/228; 269/321 N
[51] Int. Cl.[2] ..... B25B 1/14
[58] Field of Search ..... 269/228, 321 N, 143

[56] References Cited

UNITED STATES PATENTS

| | | | |
|---|---|---|---|
| 2,466,937 | 4/1949 | Downs | 269/228 |
| 2,855,964 | 10/1958 | Zelazny | 269/228 |
| 2,921,486 | 1/1960 | Burke | 269/228 |

FOREIGN PATENTS OR APPLICATIONS

| | | | |
|---|---|---|---|
| 719,634 | 12/1954 | United Kingdom | 269/228 |

*Primary Examiner*—Al Lawrence Smith
*Assistant Examiner*—Robert C. Watson
*Attorney, Agent, or Firm*—Blair & Brown

[57] ABSTRACT

A quick release pipe vise having a base plate with a set of lower jaws secured thereto. An upper jaw frame is pivotally secured to the base plate and carries a screw adjustable upper jaw which can be brought into clamping relation with the lower jaw when the upper jaw frame is locked in its upper position. An over dead center linkage extends from the upper part of the frame to the base plate and when in over center locked position rigidly secures the upper jaw frame in its upright operative position. A handle on the over center linkage permits the linkage to be moved out of its locked over center position to pivot the upper jaw frame away from its upright position to thus move the upper jaw away from the lower jaw to release pipe clamped therebetween.

3 Claims, 4 Drawing Figures

10
11
12
13
14
15
16
17
18
19
20
21
22
23
24
25
26
27
28
29
30
31
32
33
34
35
36
37

QUICK RELEASE PIPE VISE

BACKGROUND OF THE INVENTION

FIELD OF THE INVENTION

The present invention relates to quick release pipe vises.

SUMMARY OF THE INVENTION

The primary object of the invention is to provide a pipe vise which can be adjusted for clamping pipe between its jaws and then can be released and applied by means of an over center linkage so as to permit pipe to be rapidly clamped and released.

Other objects and advantages will become apparent in the following specification when considered in light of the attached drawings.

DESCRIPTION OF THE PREFERRED EMBODIMENT

Figure 2:
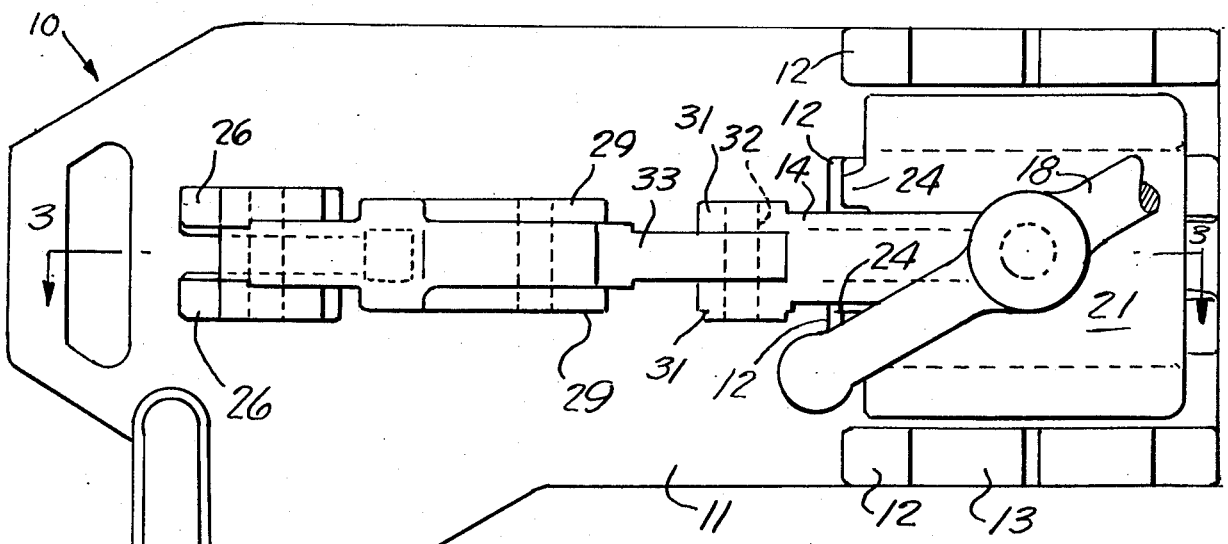
FIG. 2 is a top plan view of the invention.
Figure 1:
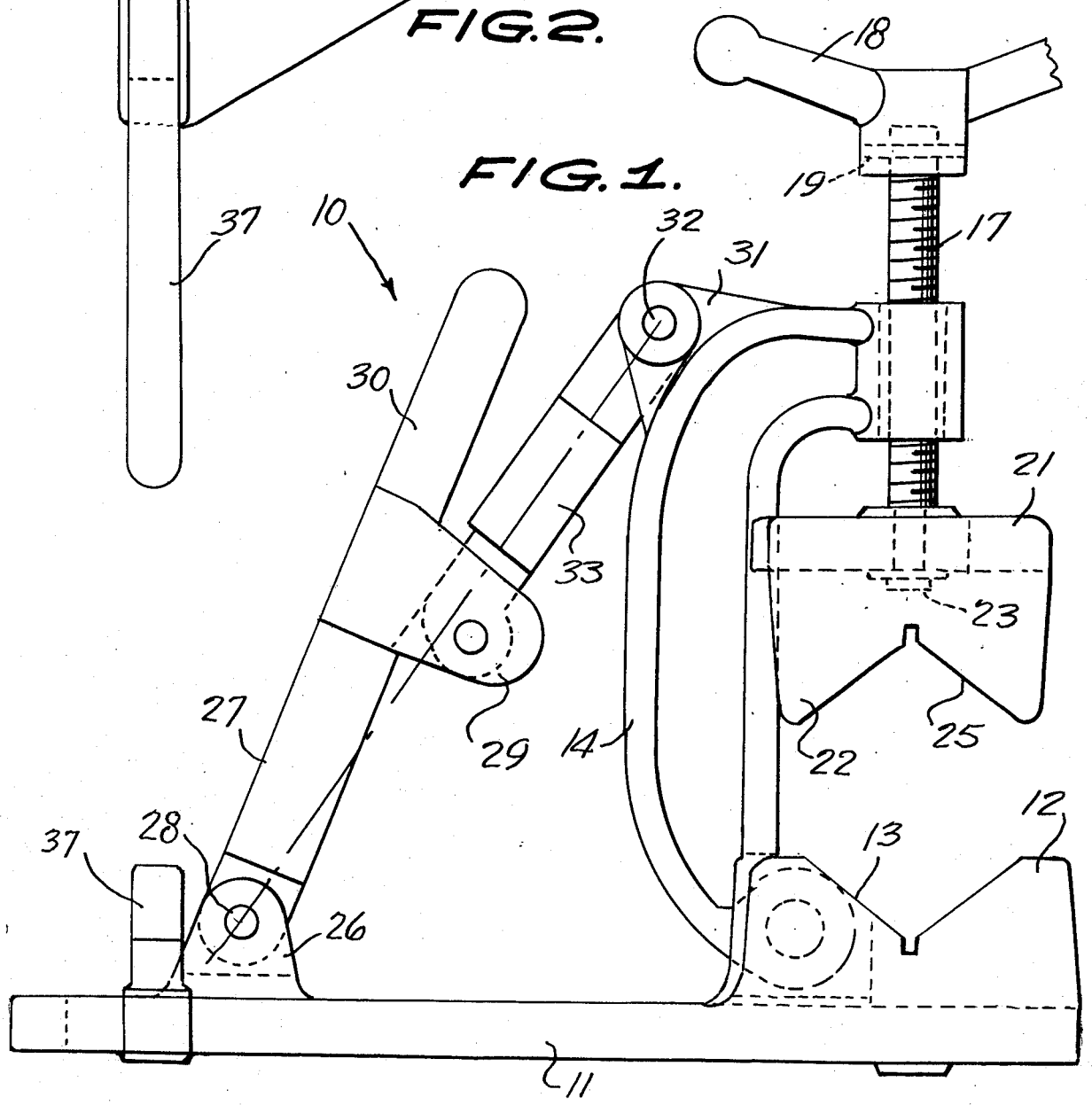
FIG. 1 is a side elevation of the invention.

Referring now to the drawings in detail wherein like reference characters indicate like parts throughout the several figures the reference numeral 10 indicates generally a quick release pipe vise constructed in accordance with the invention.

The vise 10 includes a base plate 11 which is generally flat and normally positioned horizontally. The base plate 11 can be secured to any desired support by conventional means (not shown).

A plurality of lower jaws 12 are secured to the base plate 11 in spaced apart parallel relation with each of the jaws 12 having a generally V-shaped jaw face 13 for engaging pipe resting thereon.

Figures 3, 4:
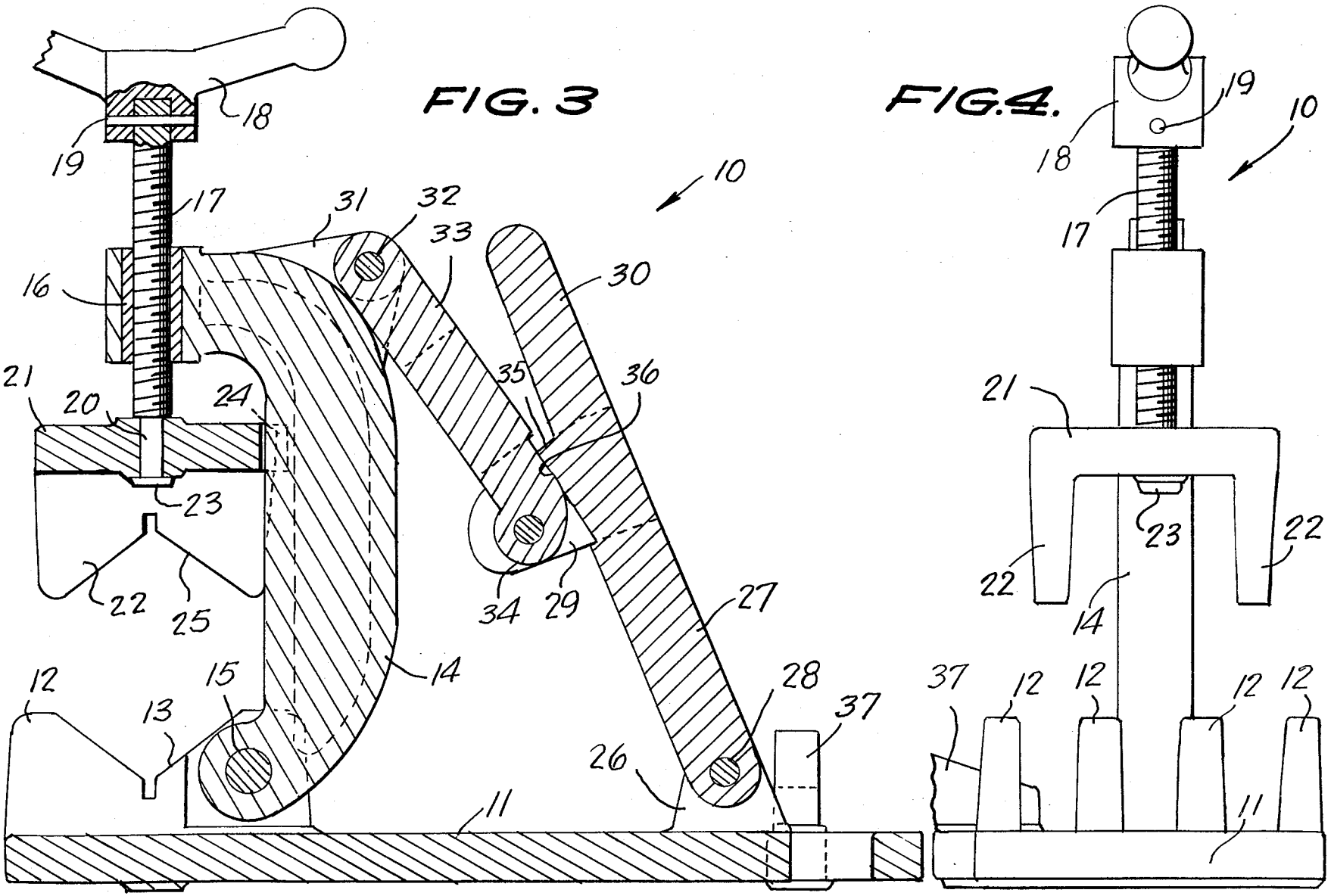
FIG. 3 is a vertical sectional view taken along the line 3—3 of FIG. 2 looking in the direction of the arrows.
FIG. 4 is an end elevation of the invention.

A C-shaped upper frame member 14 has its lower end positioned between the innermost of the jaws 12 and is pivotally secured thereto by a generally horizontal pivot pin 15 extending perpendicularly to the frame member 14 and extending through the innermost jaws 12. A threaded bushing 16 is mounted in the upper end of the frame member 14 and has a threaded rod 17 extending therethrough. A handle 18 is fixed to the upper end of the threaded rod 17 by means of a transverse pin 19 as can be seen in FIG. 3. The threaded rod 17 has a reduced diameter portion 20 on its lower end which extends through a generally U-shaped upper jaw member 21 having a pair of depending jaws 22 mounted thereon in spaced apart parallel relation. A head 23 on the lower end of the reduced diameter portion 20 supports the jaw member 21 to prevent its dropping from the reduced diameter portion 20. The reduced diameter portion 20 is slightly smaller than the opening through which it extends in the jaw member 21 so that the jaw member 21 can remain staionary as the threaded rod 17 is rotated to raise and lower the jaw member 21 with respect to the frame member 14.

A pair of spaced parallel guides 24 are mounted on the jaw member 21 to engage opposite sides of the frame member 14 to maintain the jaw member 21 in aligned relation with the frame member 14 and with the jaws 12 on the base plate 11. The jaws 22 are arranged so as to engage between the pairs of jaws 12 on the base plate 11 as can be seen in FIG. 4. The jaws 22 each have an inverted V-shaped jaw face 25 for engaging the upper surfaces of pipe resting on the jaws 12.

A pair of ears 26 are rigidly secured to the base plate 11 in spaced apart parallel relation and have an elongate link 27 pivotally secured therebetween by means of a generally horizontal pivot pin 28. The axis of the pin 28 is parallel to the axis of the pivot pin 15 of the frame 14. The link 27 has a pair of ears 29 extending from the midsection of the link 27 toward the frame member 14. The upper end of the link 27 is formed into a handle 30 for moving the link 27 as will be described below.

A pair of ears 31 are rigidly secured to the upper end portion of the frame member 14 in spaced parallel relation and have a pivot pin 32 extending thereacross with its axis parallel to the axis of the pin 15. A connecting link 33 is pivotally mounted on the pivot pin 32 between the ears 31 and extends between the ears 29 to which it is pivotally secured by a pivot pin 34.

The link 27 has an angular stop surface 35 positioned between the ears 29 for engagement with a stop surface 36 on the link 33. When the frame member 14 is in its uppermost position and the stop surfaces 35, 36 are in contact the pivot pin 34 has passed a center line drawn through the pivot pin 28 and the pivot pin 32 so as to be past dead center rigidly locking the links 27, 33 and hence the frame member 14.

In the use and operation of the invention pipe of varied diameter is supported on the lower jaws 20 by the V-shaped jaw faces 13 and the handle 18 is rotated to bring the jaw faces 25 into contact with the upper surfaces of the pipe. The pipe is then threaded or otherwise treated and on completion the handle 30 is drawn in a direction away from the frame member 14 so as to move the pivot pin 34 outwardly past its dead center position so as to permit the links 27, 33 to move to pivot the frame member 14 to the right as seen in FIG. 3 to thus release the pressure of the jaw faces 25 with the upper face of the pipe.

With the use of the links 27, 33 and the pivoting of the frame member 14 it is unnecessary to adjust the jaw faces 25 for clamping the same size pipe.

An arm 37 is rigidly secured to the base plate 11 and extends outwardly therefrom to provide a stop for power driven pipe treating equipment which is adapted to be used with the pipe vise 10.

Having thus described the preferred embodiment of the invention it should be understood that numerous structural modification and adaptations may be resorted to without departing from the spirit of the invention.

What is claimed is:

1. A pipe vise including a base plate, a plurality of spaced parallel V-shaped pipe jaws rigidly secured to said base plate, a generally C-shaped upper jaw frame member having its lower end pivotally secured to a pair of said jaws on said base plate with a generally horizontal pivot, an upper jaw member, hand controlled means extending through the upper end of said frame member for moving said upper jaw member along said frame member toward said lower jaws, and an over center linkage extending between the upper end of said frame member and said base plate at an angle to releasably rigidly support said frame member in upright position.

2. A device as claimed in claim 1 on which said linkage is provided with a handle for moving said linkage from its over center position to a released position.

3. A device as claimed in claim 1 wherein the hand controlled means for moving said upper jaw member with respect to said frame member comprises a threaded shaft threaded through the upper end of said frame member and having the jaw member secured to its lower end with a handle for rotating said screw member secured to the upper end of said screw member.

* * * * *